US009125485B2

(12) United States Patent
Nafziger et al.

(10) Patent No.: US 9,125,485 B2
(45) Date of Patent: Sep. 8, 2015

(54) PORTABLE LIGHTWEIGHT ADJUSTABLE COMPUTER TABLE

(71) Applicants: Joseph D. Nafziger, San Diego, CA (US); Benjamin A. Larson, San Diego, CA (US)

(72) Inventors: Joseph D. Nafziger, San Diego, CA (US); Benjamin A. Larson, San Diego, CA (US)

( * ) Notice: Subject to any disclaimer, the term of this patent is extended or adjusted under 35 U.S.C. 154(b) by 0 days.

(21) Appl. No.: 14/217,429

(22) Filed: Mar. 17, 2014

(65) Prior Publication Data

US 2014/0261105 A1 Sep. 18, 2014

Related U.S. Application Data

(60) Provisional application No. 61/802,871, filed on Mar. 18, 2013.

(51) Int. Cl.

| | |
|---|---|
| ***A47B 3/00*** | (2006.01) |
| ***A47B 9/08*** | (2006.01) |
| ***A47B 21/02*** | (2006.01) |
| ***A47B 9/20*** | (2006.01) |
| ***A47B 21/03*** | (2006.01) |
| ***A47B 9/14*** | (2006.01) |
| *A47B 3/08* | (2006.01) |

(52) U.S. Cl.

CPC . *A47B 9/08* (2013.01); *A47B 3/002* (2013.01); *A47B 3/0803* (2013.01); *A47B 9/14* (2013.01); *A47B 9/20* (2013.01); *A47B 21/02* (2013.01); *A47B 21/0314* (2013.01); *A47B 2003/0806* (2013.01); *A47B 2021/0321* (2013.01); *A47B 2200/0036* (2013.01); *A47B 2200/0052* (2013.01); *Y10T 29/49826* (2015.01)

(58) Field of Classification Search

CPC ..... A47B 2021/0321; A47B 3/0803; A47B 3/002; A47B 21/02; A47B 21/0314; F21V 21/08; A61G 2005/1094

USPC ..... 312/97, 115; 108/97, 115; 211/192, 211/193; 248/166, 434, 439, 173, 188.1, 248/188.6

See application file for complete search history.

(56) References Cited

U.S. PATENT DOCUMENTS

| | | | | | |
|---|---|---|---|---|---|
| 2,750,243 | A | * | 6/1956 | Zielfeldt | 108/78 |
| 3,009,752 | A | * | 11/1961 | Margulis | 312/280 |
| 3,072,451 | A | * | 1/1963 | Greenberg et al. | 108/160 |
| 3,672,722 | A | * | 6/1972 | Murcott | 297/423.38 |
| 4,436,339 | A | * | 3/1984 | Albers | 297/153 |
| 4,865,403 | A | | 9/1989 | Steinhilber | |
| 4,974,525 | A | * | 12/1990 | Sheffield | 108/118 |
| 5,433,235 | A | * | 7/1995 | Miric et al. | 135/67 |
| 5,690,239 | A | * | 11/1997 | Ballard | 211/189 |
| 5,735,222 | A | * | 4/1998 | Webb | 108/144.11 |
| 5,895,020 | A | * | 4/1999 | Danzyger et al. | 248/295.11 |
| 6,047,838 | A | * | 4/2000 | Rindoks et al. | 211/187 |

(Continued)

*Primary Examiner* — Daniel J Troy
*Assistant Examiner* — Andres F Gallego
(74) *Attorney, Agent, or Firm* — Procopio Cory Hargreaves & Savitch LLP

(57) ABSTRACT

A lightweight portable and adjustable computer table that can be located on the top of an existing office desk or table for standing computer use and be adjustable in monitor and keyboard height. The lightweight portable and adjustable computer table is dual adjustable in that both the monitor shelf and the keyboard shelf adjust in height independently to achieve ergonomically correct and comfortable positioning. By folding the table top by the means of a hinge, such as a piano hinge, against the back support member and folding the leg assemblies together, the keyboard tray can be attached for convenient storage and be easily transported using a carry handle.

11 Claims, 4 Drawing Sheets

(56) References Cited

U.S. PATENT DOCUMENTS

| | | | | |
|---|---|---|---|---|
| 6,170,407 | B1 * | 1/2001 | Hayward | 108/50.02 |
| 6,712,433 | B2 | 3/2004 | Hellwig et al. | |
| 6,773,060 | B2 * | 8/2004 | Sher et al. | 297/188.14 |
| 6,997,115 | B2 * | 2/2006 | Lockwood et al. | 108/115 |
| 7,575,212 | B1 * | 8/2009 | Langelius | 248/243 |
| 2003/0177960 | A1 * | 9/2003 | Schenker et al. | 108/115 |
| 2012/0024202 | A1 | 2/2012 | Bajric et al. | |
| 2012/0043435 | A1 * | 2/2012 | Devereux | 248/176.3 |
| 2012/0174833 | A1 | 7/2012 | Early et al. | |

* cited by examiner

PORTABLE LIGHTWEIGHT ADJUSTABLE COMPUTER TABLE

FIELD OF THE INVENTION

This application provides a unique lightweight portable and adjustable computer table that can be located on the top of an existing office desk or table for ergonomically correct standing computer use and be adjustable in monitor and keyboard height.

BACKGROUND OF THE INVENTION

Prolonged sitting at a computer desk is frequently perceived as being uncomfortable no matter what style of chair is used and is also especially disadvantageous tot health reasons. People have been advised by doctors to stand up and move around periodically. Standing while working at the computer allows the person to move freely away when needed and not have to repeatedly stand up and sit down during the work period. Drafting tables for years have been in an elevated position with a high stool where an individual could either stand or sit during the workday. This standing and sitting is beneficial during long workdays. Problems occur at some drafting tables and standing workstations with the height of the person involved. Common computer workstations at commercial locations are at the conventional lower sitting position and have no means to be adjusted to an elevated position. Workstations where operators have to be standing all the time are often crudely constructed and not commercially available. Additionally, computer equipment is rapidly getting smaller and lighter requiring less room to operate. Therefor there is a growing need for a lightweight portable and adjustable computer table that can be located on the top of an existing office desk or table and be adjustable in monitor and keyboard height as to be ergonomically correct for the user.

Numerous innovations for computer tables have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Portable Computer Table and the prior art.

U.S. Pat. No. 4,865,403 of Helmiut Steinhilber In order to be able to retrofit an existing writing desk in simple fashion with a standup desk that can be folded and slid beneath the working surface of the writing desk, the standup desk has a frame on which the guides for sliding the standup desk are provided. This frame can be placed as a free-standing bracket beneath the writing desk or tensioned between the pedestals of the writing desk or between the floor and the working surface.

This patent describes a standup desk that can be folded and slid beneath the working surface of the writing desk. This standup desk has not been designed for computer usage. It does not have the lightweight design of the Portable Computer Table, a keyboard tray or easily adjustable leg assemblies for height adjustment of the table top and the keyboard tray. It does not have the suction cups on the telescoping legs that offer a secure positioning of the device on a desk or table.

U.S. Pat. No. 6,712,433 of John Helwig et al. describes a workstation system includes, as a "core" element, a self-standing service trunk that can be used in association with free-standing desks placed adjacent the trunk, or desk structures that are physically connected to the trunk. The trunk has a top that provides a generally horizontal storage support surface above desk height, and the trunk incorporates power and communication cable troughs for delivering power and communication services from an input location on the trunk to an output location accessible from a desk associated with the trunk.

This patent describes an involved workstation and does not have the lightweight design of the Portable Computer Table.

US pending Patent Application Publication No. US 2012/0174833 A1 of Lydia Bellia Early et al. describes a vertical desk with horizontal work surface and vertical display surface upon which is attached a computer monitor or other electronic equipment to be viewed in a range of height positions.

This patent describes a vertical display stand but does not offer the advantages of a lightweight portable device that can be assembled easily and secured on top of an existing table or desk.

US pending Patent Application Publication No. US 2012/0024202 A1 of Albin Bajric describes a standing desk designed monitor holder having a frame and a monitor receptacle arrangement.

This patent describes a frame for holding a monitor but does not have a table top workspace for a monitor or the keyboard tray in a lightweight portable design. Nor does this patent describe a device that sets on top of an existing desk or table.

In this respect, before explaining at least one embodiment of this application in detail it is to be understood that the design is not limited in its application to the details of construction and to the arrangement of the components set forth in the following description or illustrated in the drawings. The Portable Computer Table is capable of other embodiments and of being practiced and carried out in various ways. In addition, it is to be understood that the phraseology and terminology employed herein are for the purpose of description and should not be regarded as limiting.

SUMMARY OF THE INVENTION

The principal advantage of the Portable Computer Table is being able to stand in an ergonomically correct position while working at the computer table.

Another advantage of the Portable Computer Table is being able to adjust the height of the monitor shelf and the keyboard shelf separately so as to ergonomically fit different users.

Another advantage of the Portable Computer Table is being able to set it up on an existing office desk or table.

Another advantage of the Portable Computer Table is having retention means such as suction cups, clamps, cables and rope on the legs to firmly hold the device in place.

Another advantage of the Portable Computer Table is being able to fold it up to a small lightweight portable single unit for stowing.

Another advantage of the Portable Computer Table is it having a carrying handle to be easily transported for use at home or in an office workplace.

Another advantage of the Portable Computer Table is that teachers can stand while teaching a computer class.

The Portable Computer Table is constructed so that the table top folds back two hundred and seventy degrees by the means of a piano hinge to rest against the back leg supporting member. The table top has a stiffener down the middle on the underside with tubular leg retainers at either end. Pivot tubes, attached to the back leg supporting member, provide a means for the leg assemblies to rotate out of or into the stored position. Shoulder screws in each of the rotating leg assemblies go through circumferential slots in the tubular leg retainers to maintain their vertical position when they are rotated.

Each leg assembly will consist of a tubular one piece front and back leg unit with a horizontal center section. Each leg will have an upper tubular section and a lower telescoping tubular section with suction cups on the distal ends. The upper tubular section and a lower telescoping tubular section will have length adjustment by either using a twist locking element with length adjust numerals primed on the lower telescoping tubular section, or a second method of length adjustment that will be the conventional spring loaded ball detents in the lower telescoping tubular section into a plurality of mating, orifices in the upper tubular section. On each of the front lea units of the rotating leg assemblies is a keyboard tray attachment plate with a plurality of keyboard tray attachment slots to allow for repositioning the keyboard tray. When the leg assemblies are folded for storage they will be held in place by the means of two spring clips holding the horizontal center sections of the rotating leg assemblies to the back leg supporting member.

The keyboard tray has two attaching members with two locking segments that correspond with the keyboard tray attachment slots in the keyboard tray attachment plate to adjust the height of the keyboard tray. A stiffener runs down the center of the keyboard tray with the back edge of the keyboard tray having a carrying handle in the center. On the underside of the keyboard tray are two clasps that slide under the horizontal center section of the folded rotating leg assemblies when the Portable Computer Table is folded and secured for storage.

The foregoing has outlined rather broadly the more pertinent and important features of the present Portable Computer Table in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the Portable Computer Table and together with the description, serve to explain the principles of this application.

For a fuller understanding of the nature and advantages of the Portable Computer Table, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE PREFERRED EMBODIMENTS

Figure 1:
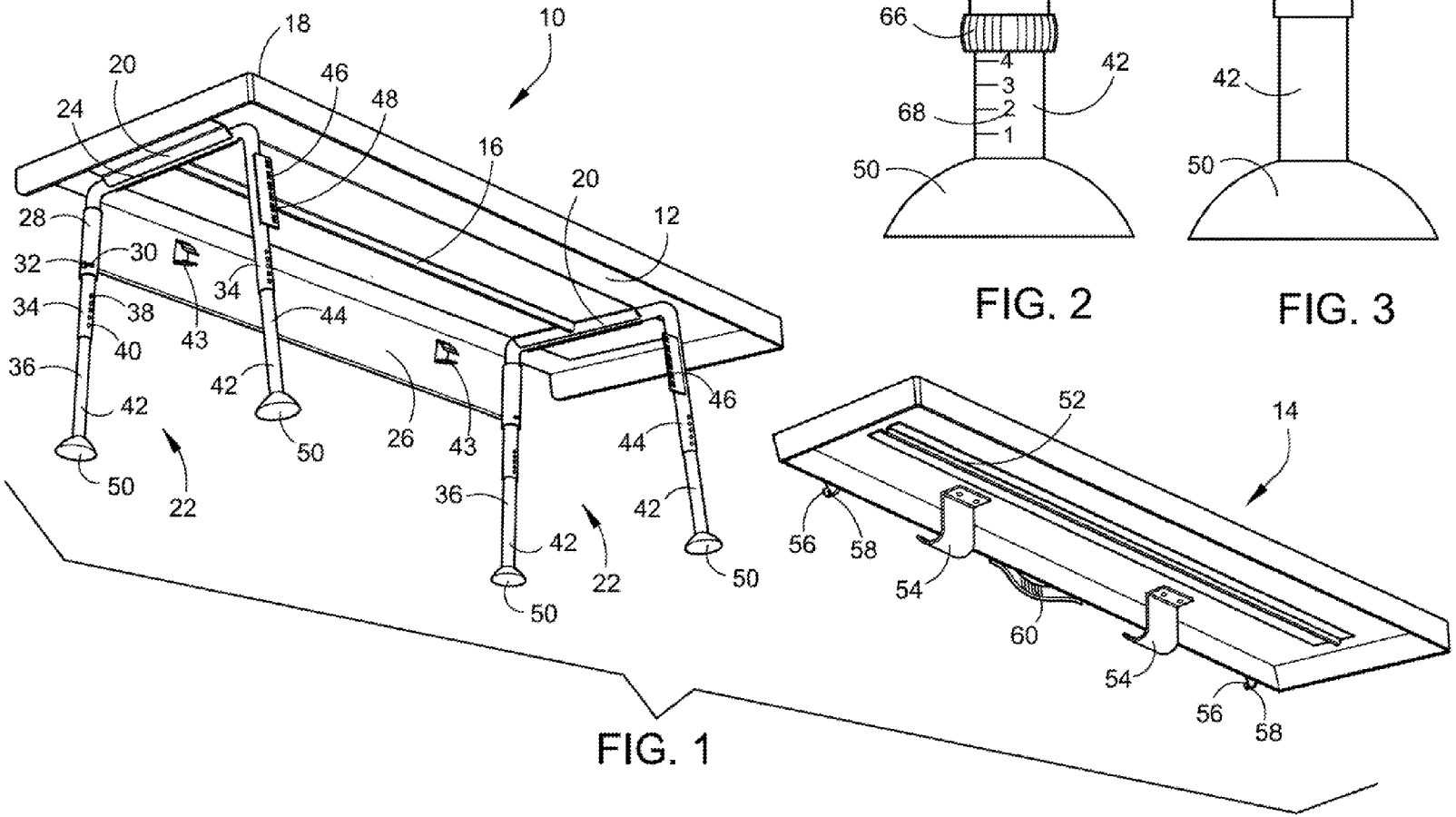
FIG. 1 depicts a perspective exploded view of the underside of the Portable Computer Table with the keyboard tray.

Referring now to the drawings, wherein similar parts of the Portable Computer Table 10 are identified by like reference numerals, there is seen in FIG. 1 a perspective exploded view of the table underside 12 of the Portable Computer Table 10 with the keyboard tray 14 moved away. A stiffener 16 runs down the underside 12 of the table top 18 incorporating the horizontal section leg retainers 20 at either end. The leg assemblies 22 are rotated out and the horizontal center sections 24 are locked in the horizontal section leg retainers 20. The back supporting member 26 has tubular leg hinge members 28 at either end with a circumferential slots 30 where shoulder screws 32 are inserted into the upper tubular sections 34 of the back leg 36. A plurality of orifices 38 in the upper tubular sections 34 are the means of height adjustment with a spring loaded ball detent 40 in the lower telescoping tubular section 42. On the front leg 44 of each leg assemblies 22 are keyboard tray attachment plates 46 with a plurality of keyboard tray attachment slots 48 to allow for repositioning the keyboard tray 14. At the distal end of the lower telescoping tubular sections 42 will be suction cups 50 to secure the Portable Computer Table 10 to a table or desk. When the leg assemblies 22 are folded for storage they will be held in place by the means of two spring clips 43 holding the horizontal center sections 24 of the rotating leg assemblies 22 to the back leg supporting member 26.

The keyboard tray 14 has a stiffener 52 down the center with two clasps 54 that slide under the horizontal center section 24 of the folded rotating leg assemblies 22 when the Portable Computer Table 10 is secured for storage. Two keyboard tray attaching members 56 with two locking segments 58 each, correspond with the keyboard tray attachment slots 48 in the keyboard tray attachment plate 46 and are used to adjust the height of the keyboard tray 14. On the hack edge of the keyboard tray 14 is a carrying handle 60.

The Portable Computer Table 10 is dual adjustable in that both the monitor shelf and the keyboard shelf adjust in height independently to achieve ergonomically correct and comfortable positioning. Ergonomically correct position for standing computer use is defined by OSHA with the main elements being: 1) the keyboard has to be at or slightly below elbow height, so that the elbows are bent between 90 and 120 degrees, and 2) the monitor has to be raised so that the head is level with eye level slightly below the top of the screen when looking straight ahead. The Portable Computer Table 10 is designed and configured to achieve this ergonomically correct position for standing computer use by having independently adjustable heights for the monitor shelf and the keyboard shelf.

Figure 2:
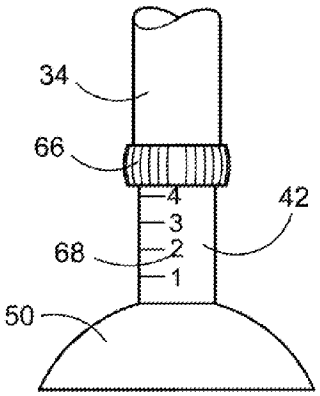
FIG. 2 depicts a side view of one method of adjusting the height of the Portable Computer Table.

FIG. 2 depicts a side view of one method of adjusting the height of the Portable Computer Table 10 by loosening the tension ring 66 on the upper tubular section 34 and moving the lower telescoping tubular sections 42 to the desired length noted by the numerals 68.

Figure 3:
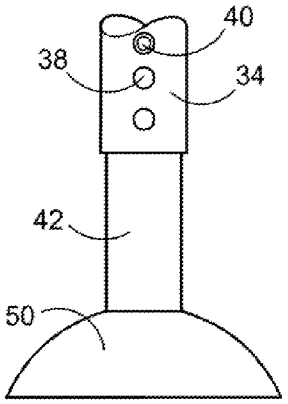
FIG. 3 depicts a side view of a second method of adjusting the height of the Portable Computer Table.

FIG. 3 depicts a side view of a second method of adjusting the height of the Portable Computer Table 10 by depressing the spring loaded ball detent 40 in the upper tubular section 34 and moving the lower telescoping tubular sections 42 to the desired length.

Figure 4:
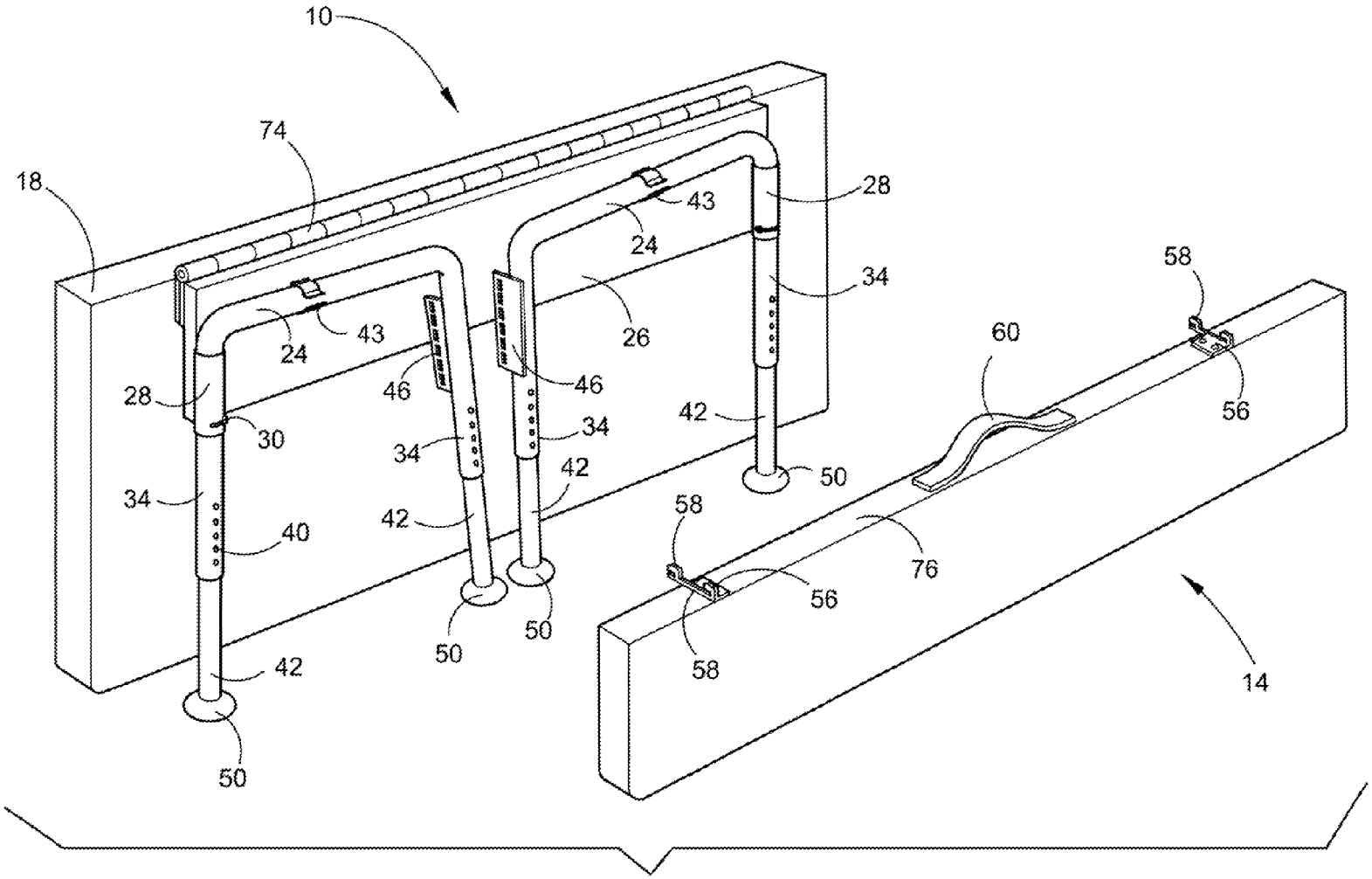
FIG. 4 depicts a perspective exploded view of the folded Portable Computer Table and the adjustable keyboard tray.

FIG. 4 depicts a perspective exploded view of the folded Portable Computer Table 10 and the adjustable keyboard tray 14. The table top 18 is folded back against the back supporting member 26 by the means of the piano hinge 74. The leg assemblies have been folded in for storage with the lower telescoping tubular sections 42 retracted and the two spring clips 43 are snapped around the horizontal center sections 24. The keyboard tray 14 is shown with the carrying handle 60 on the upper edge 76. The keyboard tray attaching members 56 with the locking segments 58 are additionally on the top edge 76 of the keyboard tray 14.

Figure 5:
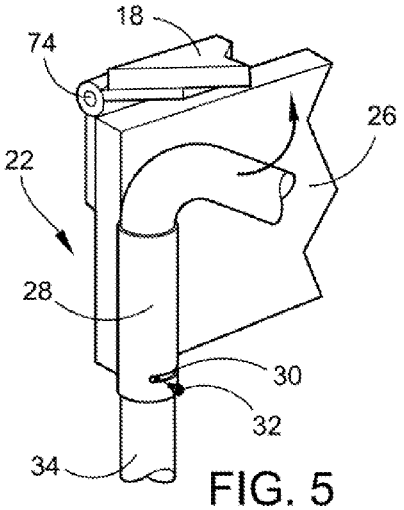
FIG. 5 depicts a perspective view of the means of rotating the leg assembly.

FIG. 5 depicts a perspective view of the tubular leg hinge member 28 as a means of rotating the leg assembly 22 where the shoulder screw 32 translates through the circumferential slot 30 to allow limited rotation and stopping any vertical movement.

Figure 6:
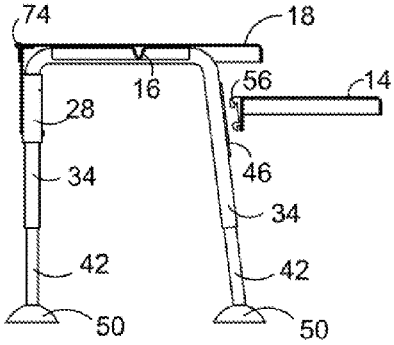
FIG. 6 depicts a cross section side view through the upright Portable Computer Table and keyboard tray.

FIG. 6 depicts a cross section side view through the upright Portable Computer Table 10 and keyboard tray 14.

Figure 7:
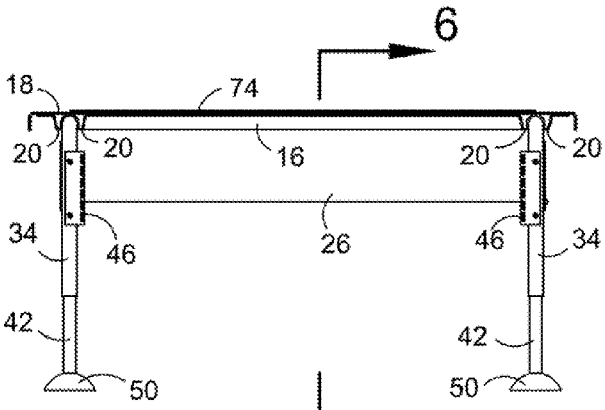
FIG. 7 depicts a cross section front view through the upright Portable Computer Table.

FIG. 7 depicts a cross section front view through the upright Portable Computer Table 10.

Figure 8:
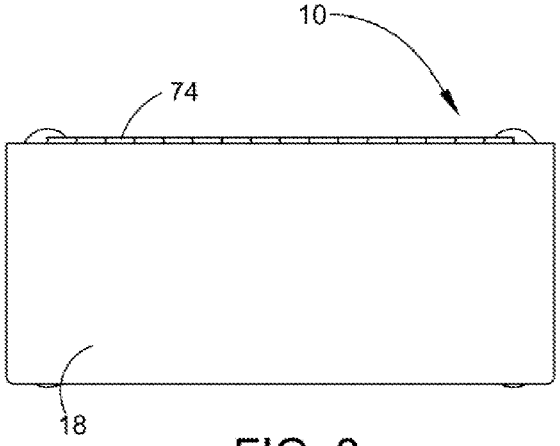
FIG. 8 depicts top view of the Portable Computer Table.

FIG. 8 depicts top view of the Portable Computer Table 10.

Figure 9:
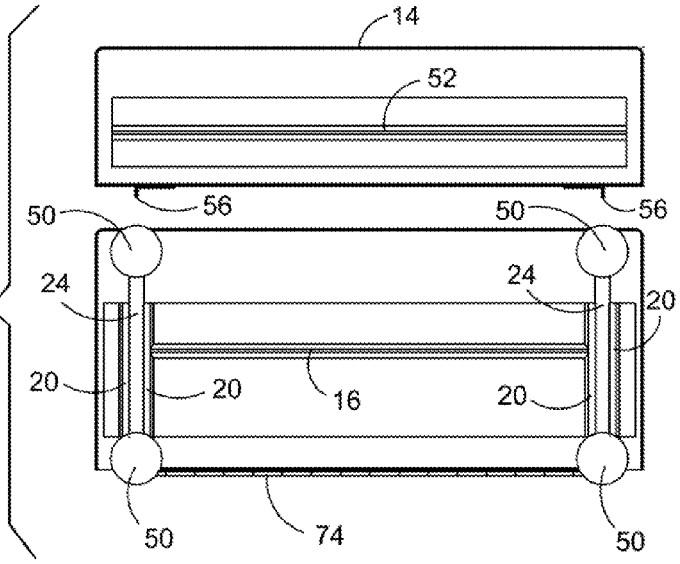
FIG. 9 depicts an exploded bottom view of the Portable Computer Table and keyboard tray.

FIG. 9 depicts an exploded view of the bottom view of the Portable Computer Table 10 and keyboard tray 14.

Figure 10:
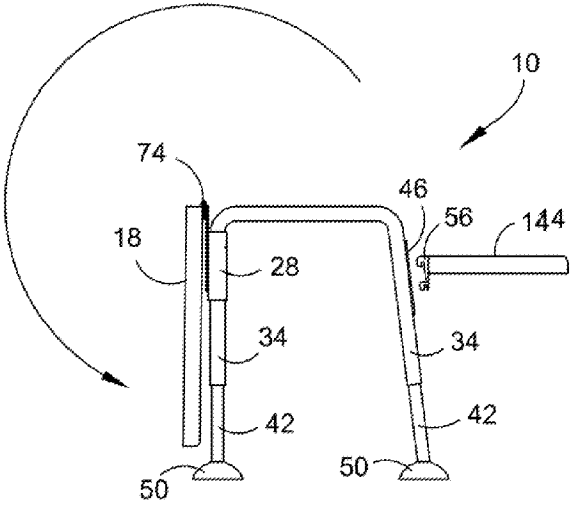
FIG. 10 depicts a side view of the Portable Computer Table and keyboard tray indicating the rotational movement of the table top for the disassembling of the device.

FIG. 10 depicts a side view of the Portable Computer Table 10 and keyboard tray 14 indicating the rotational movement of the table top 18 at the disassembly.

Figure 11:
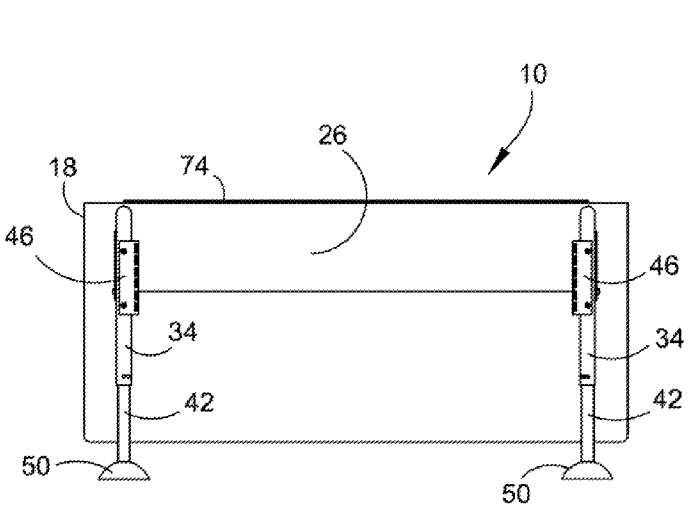
FIG. 11 depicts a cross sectional front view of the Portable Computer Table illustrating the location of the keyboard tray mounting elements.

FIG. 11 depicts a cross sectional front view of the Portable Computer Table 10 illustrating the location of the keyboard tray 14 mounting elements.

Figure 12:
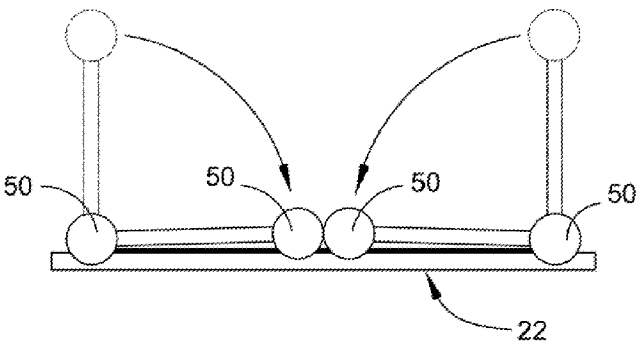
FIG. 12 depicts a bottom view of the Portable Computer Table illustrating the rotation of the leg assemblies into the stored position.

FIG. 12 depicts a bottom view of the Portable Computer Table 10 illustrating the rotation of the leg assemblies 22 into the stored position.

In summary some of the features of the Portable Computer Table 10 as shown and described, the various embodiments of the present invention are as follows:

- dual adjustable, both monitor shelf and keyboard shelf readily adjust
- ergonomically correct, to hold keyboard and monitors at ideal heights
- readily folds up
- provides space for one or two computer monitors
- provides space for mouse and keyboard
- can be used at home, work or during travel (hotels)
- is portable as one folded up unit
- lightweight and can be carried with one band
- can be anchored to platform via suction, clamp or rope
- can be readily stowed
- allows computer cables to be fastened to legs via clips or ties
- works with all existing platforms
- built in handle
- is lightweight
- is load-bearing
- is able to be placed at different areas atop platform
- lens adjust via one of the following four means: press-button, telescoping, simple notches, and threaded/screw-like function
- keyboard shelf detaches (so the unit can be used with or without a keyboard shelf)
- able to support additional shelving (for computer supplies, etc.)

The Portable Computer Table 10 shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Portable Computer Table 10 in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A portable lightweight adjustable computer table comprising:

a foldable table top having a top surface and an underside surface;

table leg retaining means attached to said table top underside surface;

foldable height adjustable table legs attached to said table leg retaining means, said foldable height adjustable table legs including horizontal center sections; and keyboard tray attachment means and a keyboard tray, said keyboard tray height adjustably and removably attached to said keyboard tray attachment means, wherein said foldable height adjustable table legs include a front and said keyboard tray includes a rear, and said keyboard tray attachment means include keyboard tray attachment plates attached to the front of the foldable height adjustable table legs; said keyboard tray including a top surface and underside surface said underside surfaces including clasps configured to slide under the horizontal center sections of the foldable height adjustable table legs when the portable lightweight adjustable computer table is in a folded and secured position for storage;

whereby said foldable table top and foldable height adjustable legs can be folded to configure a compact portable lightweight single unit that is readily transportable, wherein the compact portable lightweight single unit is configured to be carried by the keyboard tray via the clasps.

2. The portable lightweight adjustable computer table according to claim 1, wherein said foldable height adjustable table legs include a twist locking height adjustment element.

3. The portable lightweight adjustable computer table according to claim 2, wherein said twist locking height adjustment element includes height indicating numerals thereon.

4. The portable lightweight adjustable computer table according to claim 1, wherein said foldable height adjustable table legs includes retention means for the purpose of securing the table legs to a platform.

5. The portable lightweight adjustable computer table according to claim 4, wherein said foldable height adjustable table legs includes suction cup retention means.

6. The portable lightweight adjustable computer table according to claim 1 further comprising:

a back leg supporting member including opposite ends coupled to the foldable table top;

tubular hinge members at the opposite ends of the back leg supporting member and including circumferential slots and fasteners in the circumferential slots whereby the foldable height adjustable legs rotate in the tubular hinge members and the fasteners translate through the circumferential slots to allow limited rotation and prevent any vertical movement.

7. The portable lightweight adjustable computer table according to claim 1, wherein said foldable height adjustable table legs include a spring detent height adjustment element having uniformly spaced spring loaded ball detents.

8. The portable lightweight adjustable computer table according to claim 1, wherein said keyboard tray attachment plates include a plurality of keyboard tray attachment slots for the purpose of keyboard height adjustment.

9. The portable lightweight adjustable computer table according to claim 1, further including table leg retaining spring clips for the purpose of securing said foldable height adjustable table legs when in the folded position.

10. The portable lightweight adjustable computer table according to claim 1, further including a carry handle.

11. The portable lightweight adjustable computer table according to claim 1, wherein said foldable table top having a top surface and an underside surface and said table leg retaining means rotatably attached to said table to underside surface, further include hinges for the purpose of folding.

* * * * *